US010283071B2

(12) United States Patent
Liu et al.

(10) Patent No.: US 10,283,071 B2
(45) Date of Patent: May 7, 2019

(54) DRIVING APPARATUS AND METHOD

(71) Applicant: Novatek Microelectronics Corp., Hsinchu (TW)

(72) Inventors: I-Te Liu, Chiayi County (TW); Chia-Wei Chang, Taoyuan (TW); Chien-Yu Chen, Hsinchu County (TW); Hsien-Wen Lo, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 15/891,389

(22) Filed: Feb. 8, 2018

(65) Prior Publication Data

US 2018/0166030 A1 Jun. 14, 2018

Related U.S. Application Data

(63) Continuation-in-part of application No. 15/614,629, filed on Jun. 6, 2017.

(60) Provisional application No. 62/393,099, filed on Sep. 12, 2016.

(51) Int. Cl.
*G09G 3/20* (2006.01)
*G09G 3/36* (2006.01)

(52) U.S. Cl.
CPC ..... *G09G 3/3696* (2013.01); *G09G 3/20* (2013.01); *G09G 2320/0276* (2013.01); *G09G 2320/0285* (2013.01); *G09G 2320/046* (2013.01)

(58) Field of Classification Search
CPC ..... G09G 3/30–3291
See application file for complete search history.

(56) References Cited

U.S. PATENT DOCUMENTS

| | | | | |
|---|---|---|---|---|
| 9,881,568 | B2 * | 1/2018 | Na | G09G 3/3607 |
| 2007/0115232 | A1 * | 5/2007 | Urisu | G09G 3/006 345/88 |
| 2012/0038660 | A1 * | 2/2012 | Han | G09G 3/2003 345/590 |
| 2014/0184671 | A1 | 7/2014 | Lee | |
| 2015/0084947 | A1 * | 3/2015 | Lin | G09G 3/3688 345/212 |
| 2015/0332638 | A1 * | 11/2015 | Li | G09G 3/3648 345/214 |
| 2016/0093243 | A1 * | 3/2016 | Su | G09G 3/2003 345/690 |
| 2016/0171939 | A1 * | 6/2016 | Na | G09G 3/20 345/690 |

(Continued)

*Primary Examiner* — Patrick F Marinelli
(74) *Attorney, Agent, or Firm* — JCIPRNET

(57) ABSTRACT

An integrated circuit for driving a display panel is provided. The integrated circuit includes a gamma mapping circuit and a mura compensation circuit. The gamma mapping circuit is configured to receive a gray level of an image data, map the gray level to a gamma code according to at least one gamma table, and output the gamma code. The mura compensation circuit is configured to receive the gamma code, and compensate the gamma code according to at least one de-mura table to generate a compensation result after the gamma mapping circuit performs the step of mapping the gray level to the gamma code. The integrated circuit drives the display panel according to the compensation result. In addition, a method for driving a display panel is also provided.

7 Claims, 11 Drawing Sheets

| Gamma Code | Mura Calibration Data | | |
|---|---|---|---|
| | MN | MA | MB |
| 0 | 0 | 0 | 0 |
| 1 | 0 | −1 | +1 |
| ⋮ | ⋮ | ⋮ | ⋮ |
| 2867 | 0 | −205 | +205 |
| ⋮ | ⋮ | ⋮ | ⋮ |
| 4094 | 0 | −399 | +399 |
| 4095 | 0 | −400 | +400 |

(56) References Cited

U.S. PATENT DOCUMENTS

| | | | | |
|---|---|---|---|---|
| 2018/0075802 | A1* | 3/2018 | Liu | G09G 3/3233 |
| 2018/0082627 | A1* | 3/2018 | Deng | G09G 3/3208 |
| 2018/0158434 | A1* | 6/2018 | Bian | G09G 5/06 |
| 2018/0166030 | A1* | 6/2018 | Liu | G09G 3/20 |
| 2018/0190213 | A1* | 7/2018 | Zhang | G09G 3/36 |

* cited by examiner

DRIVING APPARATUS AND METHOD

CROSS-REFERENCE TO RELATED APPLICATION

This application is a continuation-in-part application of and claims the priority benefit of a prior application Ser. No. 15/614,629, filed on Jun. 6, 2017. The prior application Ser. No. 15/614,629 claims the priority benefit of U.S. provisional application Ser. No. 62/393,099, filed on Sep. 12, 2016. The entirety of each of the above-mentioned patent applications is hereby incorporated by reference herein and made a part of this specification.

BACKGROUND

Technical Field

The disclosure generally relates to a display apparatus, in particular, to a driving apparatus for a display panel and a driving method thereof.

Description of Related Art

The advanced opto-electronic and semiconductor technology brings about the prosperous development of flat panel displays, curve panel displays or stereoscopic displays. Flat panel displays include displays of several different technologies, among which the liquid crystal display (LCD) has become the mainstream on the market for its characteristics such as high space utilization, low power consumption, absence of radiation, and low electromagnetic interference.

In the framework of liquid crystal displays nowadays, a gamma voltage generating apparatus is required for a source driver of a liquid crystal driver to generate a plurality of gamma voltages according to a gamma table, and control the liquid crystal display panel to display corresponding gray level values accordingly, thereby displaying high-quality images. A setting of the gamma table may change according to different display panels. In addition, a display panel is manufactured through a series of complicated processes. If a small defect appears in one of the processes, quality of the display panel may be adversely affected and visible defects may appear. One such viewing defect is the so-called "mura effect", for example.

Various imperfections in the display components may result in undesirable modulations of the luminance, causing the mura defects. There are many stages in the manufacturing process that may result in Mura defects on the display. "Mura" defects cause one or more pixels to be brighter or darker than surrounding pixels, resulting contrast-type defects. Generically, such contrast-type defects may be identified as "blobs", "bands", "streaks", etc. Mura defects may also be referred to as "Alluk" defects or generally non-uniformity distortions. Mura defects may appear as low frequency, high-frequency, noise-like, and/or very structured patterns on the display.

SUMMARY

Accordingly, the disclosure is directed to a driving apparatus for a display panel and a method for driving the display panel, in which the mura effect may be reduced.

An exemplary embodiment of the disclosure provides a driving apparatus for a display panel. The driving apparatus includes a conversion circuit and a voltage generating circuit. The conversion circuit receives an image data, selects a gamma table among a plurality of gamma tables, maps a gray level of the image data to a gamma code according to the selected gamma table, and generates a compensation result by compensating the gamma code according to a common de-mura table no matter which one of the gamma tables is selected. The voltage generating circuit is coupled to the conversion circuit for receiving the compensation result. The voltage generating circuit generates at least one display voltage for driving the display panel according to the compensation result.

An exemplary embodiment of the disclosure provides a method for driving a display panel includes: selecting a gamma table among a plurality of gamma tables by a conversion circuit; mapping a gray level of an image data to a gamma code according to the selected gamma table by the conversion circuit; generating a compensation result by compensating the gamma code according to a common de-mura table no matter which one of the gamma tables is selected by the conversion circuit; and generating a display voltage for driving the display panel according to the compensation result by a voltage generating circuit.

An exemplary embodiment of the disclosure provides a driving apparatus for a display panel. The driving apparatus includes a conversion circuit and a voltage generating circuit. The conversion circuit receives an image data, and generates a compensation result by compensating a gray level of the image data according to at least one gamma-based de-mura table recording de-mura information, wherein the de-mura information is constructed based on gamma mapping information. The voltage generating circuit is coupled to the conversion circuit for receiving the compensation result. The voltage generating circuit generates a display voltage for driving the display panel according to the compensation result.

An exemplary embodiment of the disclosure provides a method for driving a display panel includes: generating a compensation result by compensating a gray level of an image data according to at least one gamma-based de-mura tables recording de-mura information by a conversion circuit, wherein the de-mura information is constructed based on gamma mapping information; and generating a display voltage for driving the display panel according to the compensation result.

The disclosure also discloses a display device, which comprises a display panel and a driving apparatus configured to have the structures or to perform the steps as illustrated by any of the above embodiments, alone or combined. The disclosure also disclose an electronic device having the display device.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
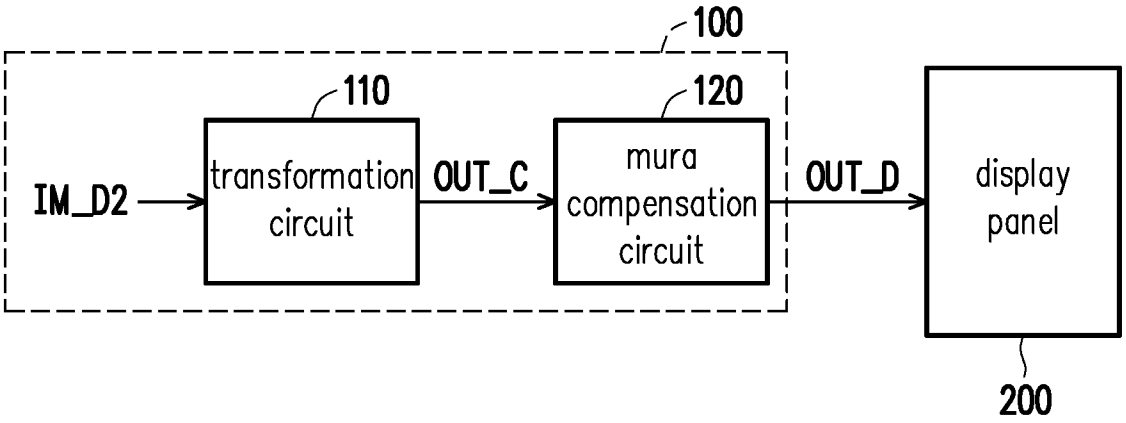
FIG. 1 illustrates a schematic diagram of a driving apparatus for a display panel according to an exemplary embodiment.

Reference will now be made in detail to the present preferred embodiments of the disclosure, examples of which are illustrated in the accompanying drawings. Wherever possible, the same reference numbers are used in the drawings and the description to refer to the same or like parts.

The term "coupling/coupled" used in this specification (including claims) of the disclosure may refer to any direct or indirect connection means. For example, "a first device is coupled to a second device" should be interpreted as "the first device is directly connected to the second device" or "the first device is indirectly connected to the second device through other devices or connection means." In addition, the term "signal" can refer to a current, a voltage, a charge, a temperature, data, electromagnetic wave or any one or multiple signals.

Figure 2:
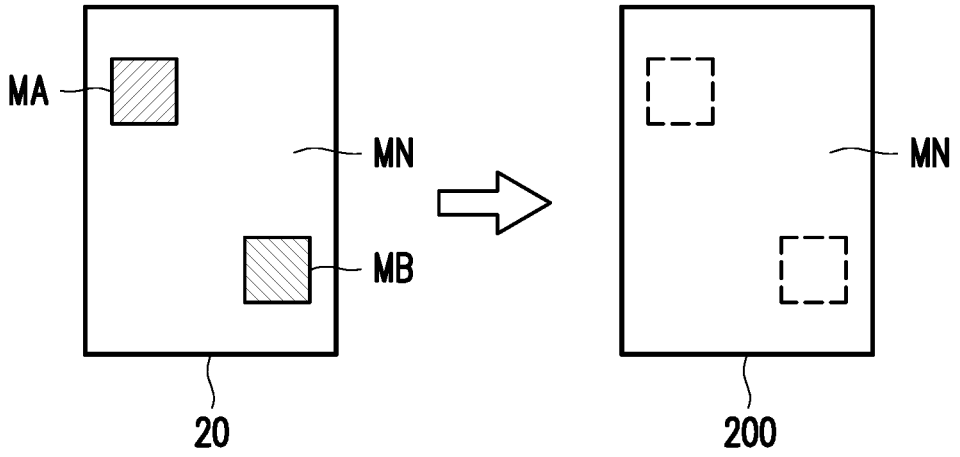
FIG. 2 illustrates the display panel depicted in FIG. 1 before mura compensation and after mura compensation.

FIG. 1 illustrates a schematic diagram of a driving apparatus for a display panel according to an exemplary embodiment. FIG. 2 illustrates a display panel such as the display panel depicted in FIG. 1 (but not limited thereto) before mura compensation and after mura compensation.

Referring to FIG. 1 and FIG. 2, a driving apparatus 100 of the present embodiment includes a transformation circuit 110 and a mura compensation circuit 120. The transformation circuit 110 is configured to perform a non-linear transformation on an image data IM_D2 to generate an output code OUT_C based on one or more characteristics of a display panel 200 such as process, material, gamma parameter, brightness or color temperature. The mura compensation circuit 120 is configured to receive the output code OUT_C from the transformation circuit 110, and compensate the output code OUT_C to reduce a mura effect of the display panel 200 and generate a compensation result OUT_D after the transformation circuit 110 performs the non-linear transformation. The driving apparatus 100 drives the display panel 200 according to the compensation result OUT_D.

In an embodiment, the non-linear transformation of the transformation circuit 110 may include a gamma mapping. The gamma mapping is a non-linear operation used to encode and decode the image data IM_D2. For example, the transformation circuit 110 may map a gray level of the image data IM_D2 to a gamma code according to at least one gamma table, and output the gamma code. The gamma table may be stored in the driving apparatus 100 such as a memory or circuit for implementing the non-linear transformation.

As shown in FIG. 2, the display panel 20 includes a plurality of panel areas such as MA and MB having mura phenomenon before mura compensation. In the present embodiment, the mura compensation circuit 120 compensates the output code OUT_C and generates the compensation result OUT_D. The driving apparatus 100 drives the display panel 200 according to the compensation result OUT_D. The mura effect of the display panel 200 can be reduced, and thus the display panel 200 can provide better display quality. It is noted each of the panel areas receiving mura compensation can include one or more pixels or sub-pixels.

In the present embodiment, the block circuits of the driving apparatus 100 may be implemented by using adaptive circuit structures in the related art, which are not particularly limited in the disclosure. In the present embodiment, the display panel 200 includes a flat panel, a curved panel or a 3D display, including Liquid Crystal Display (LCD), Plasma Display Panel (PDP), Organic Light Emitting Display (OLED), Field Emission Display (FED), Electro-Phoretic Display (EPD) or Light Emitting Diode Display and the like, which are not limited in the disclosure. Moreover, the display panel may be integrated with other function (such as a touch function to form such as a touch display panel).

Figure 3:
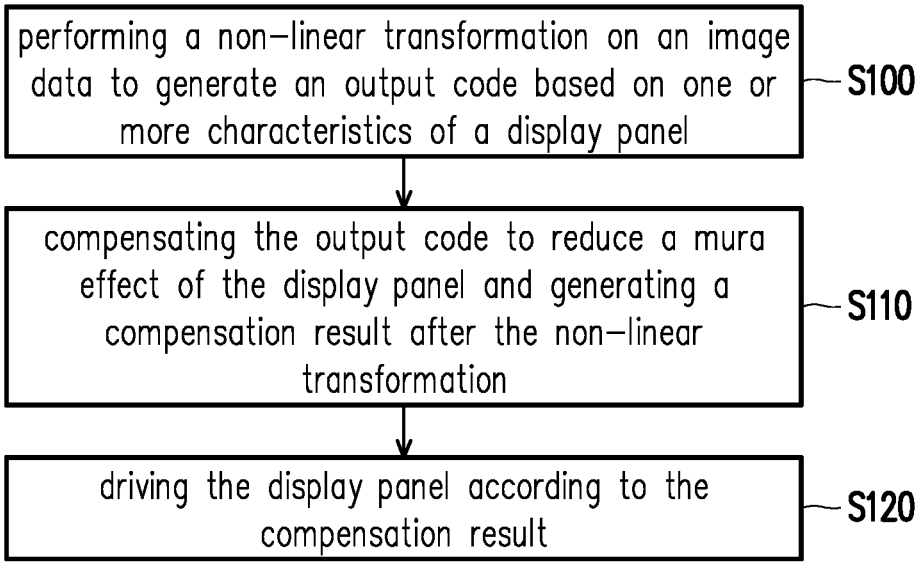
FIG. 3 is a flowchart illustrating steps in a method for driving a display panel according to an exemplary embodiment.

FIG. 3 is a flowchart illustrating steps in a method for driving a display panel according to an exemplary embodiment. Referring to FIG. 1 and FIG. 3, the method of the present embodiment can at least be adapted to the driving apparatus 100 of FIG. 1, but the disclosure is not limited thereto. Taking the driving apparatus 100 for example, in step S100, the transformation circuit 110 performs a non-linear transformation on an image data IM_D2 to generate an output code OUT_C based on one or more characteristics of the display panel 200. The non-linear transformation can transform linear image data (or gray level) to a nonlinear output of source voltage or data voltage. The transformation may be performed based on curves representing relationships between luminance on the display panel 200 and source voltage (or gamma code). In some implementations, the nonlinear transformation can be gamma mapping but not limited thereto. With such a non-linear transformation, the luminance on the display panel 200 can demonstrate a non-linear relationship (e.g., $\gamma$ 2.2) so as to match viewing characteristics of human eyes. The transformation can be set differently according to characteristics of display panel, $\gamma$ value, luminance, and color temperatures.

In step S110, the mura compensation circuit 120 compensates the output code OUT_C to reduce a mura effect of the display panel 200 and generates a compensation result OUT_D after the non-linear transformation. The mura compensation can compensate for non-uniformity with respect to a measured relationship between luminance and gray level for pixels or sub-pixels on the display panel 200. After display panels are manufactured, curves representing relationship between luminance and gray level for pixels or sub-pixels on the display panels can be measured such as by cameras. Mura effect causes the curves for different pixels/ sub pixels to differ from each other. The compensation for each gray level can therefore be performed based on the difference between the curves. As a result, data for compensating the source voltages (compensation data) can be generated by using the curve difference. The compensation data can be stored in a memory such as a SRAM.

In step S120, the driving apparatus 100 drives the display panel 200 according to the compensation result OUT_D. The compensation result OUT_D can produce uniform display since the source voltage or the output code OUT_C have been compensated to reduce or eliminate the luminance difference between pixels/sub-pixels.

It is noted that the mura compensation can be based on differences between the curves representing the relationship between the luminance of sub-pixels/pixels and source voltages. In this way, even when the setting for the nonlinear transformation or gamma mapping is modified, the same setting or data for mura compensation can be used, because the curves representing the relationship between the luminance of sub-pixels/pixels and source voltages depend only upon characteristics of the display panel instead of the setting for the gamma mapping or nonlinear transformation. Consequently, the configuration of the embodiment may be implemented with a fixed amount of space for storing the mura compensation data, without being affected by adjustment of the gamma mapping or nonlinear transformation.

In addition, sufficient teaching, suggestion, and implementation illustration regarding the method for driving the display panel of the exemplary embodiment may be obtained from the foregoing embodiments of FIG. 1 to FIG. 2, and thus related description thereof is not repeated hereinafter.

Figure 4:
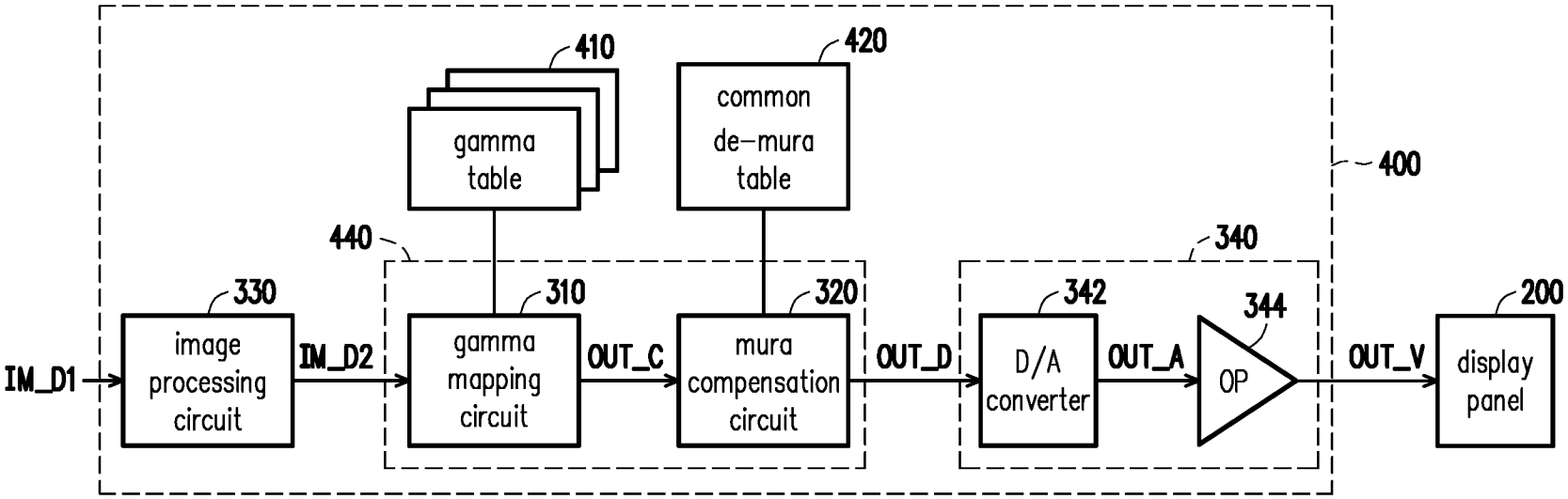
FIG. 4 illustrates a circuit block diagram of a driving apparatus for a display panel according to another exemplary embodiment.

FIG. 4 illustrates a circuit block diagram of a driving apparatus 400 for a display panel 200 according to another exemplary embodiment. The driving apparatus 400 of the present embodiment includes an image processing circuit 330, a conversion circuit 440, and a voltage generating circuit 340.

The image processing circuit 330 receives an image data IM_D1 and performs image processing operations, such as image enhancement, sub-pixel rendering, etc., on the image data IM_D1 to generate image data IM_D2. According to the design requirement, the image processing operations include saturation processing, hue processing, contrast adjustment, sharpness adjustment, gamut adjustment, brightness adjustment, sub-pixel rendering, IR drop compensation and/or other image processing. The image processing circuit 330 outputs the image data IM_D2 to the conversion circuit 440.

The conversion circuit 440 is coupled to the image processing circuit 330 for receiving the image data IM_D2. The driving apparatus 400 have a plurality of gamma tables (e.g. the gamma table 410 in FIG. 4). Each of the gamma tables records relationship between a plurality of gamma codes and a plurality of gray levels. The gamma tables are used in different operation situations. In general, Gamma curve can be adjusted for different scene modes (e.g., brightness, color temperature, etc.). For example, one of the gamma tables is used for dark scene mode, but another one of the gamma tables is used for bright scene mode. The conversion circuit 440 selects a selected gamma table 410 among the gamma tables. The conversion circuit 440 maps a gray level of the image data IM_D2 to a gamma code according to the selected gamma table 410, and compensates the gamma code according to a common de-mura table 420 to generate a compensation result OUT_D. The common de-mura table 420 is the same when the selected gamma table 410 is changed.

The voltage generating circuit 340 coupled to the conversion circuit 440 for receiving the compensation result OUT_D. The voltage generating circuit 340 generates a display voltage OUT_V for driving the display panel 200 according to the compensation result OUT_D.

Figure 5:
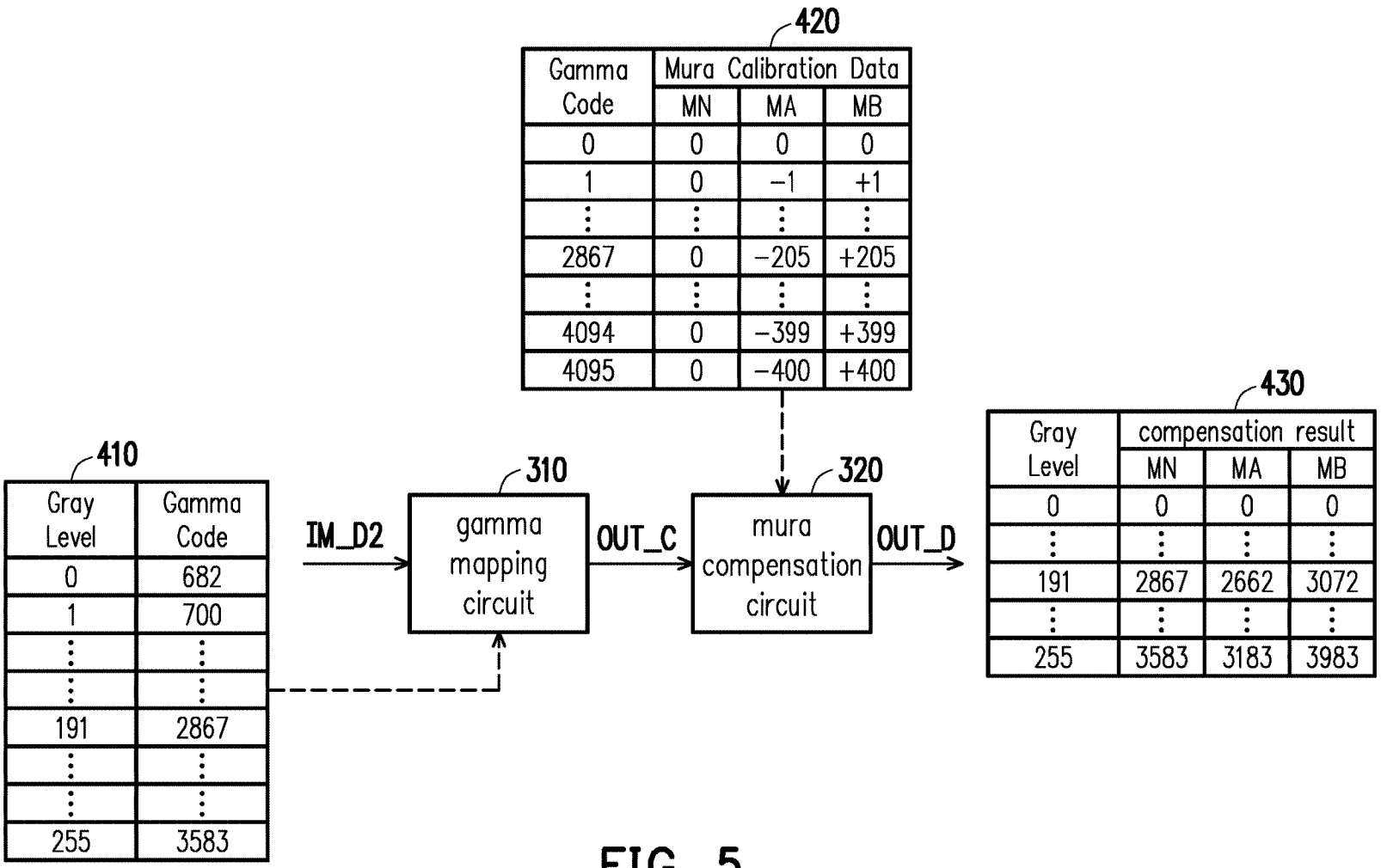
FIG. 5 illustrates the gamma mapping circuit and the mura compensation circuit depicted in FIG. 4.

In the present embodiment, the conversion circuit 440 includes a gamma mapping circuit 310 and a mura compensation circuit 320. FIG. 5 illustrates a gamma mapping circuit and a mura compensation circuit. FIG. 5 can be applied to (but not limited to) the gamma mapping circuit 310 and the mura compensation circuit 320 depicted in FIG. 4. Referring to FIG. 4 and FIG. 5, the image processing circuit 330 outputs the image data IM_D2 to the gamma mapping circuit 310. The gamma mapping circuit 310 receives a gray level of the image data IM_D2. The gamma mapping circuit 310 selects the selected gamma table 410 among the plurality of gamma tables. The gamma mapping circuit 310 maps the gray level to a gamma code OUT_C according to the selected gamma table 410, and outputs the gamma code OUT_C to the mura compensation circuit 320.

Figure 6A:
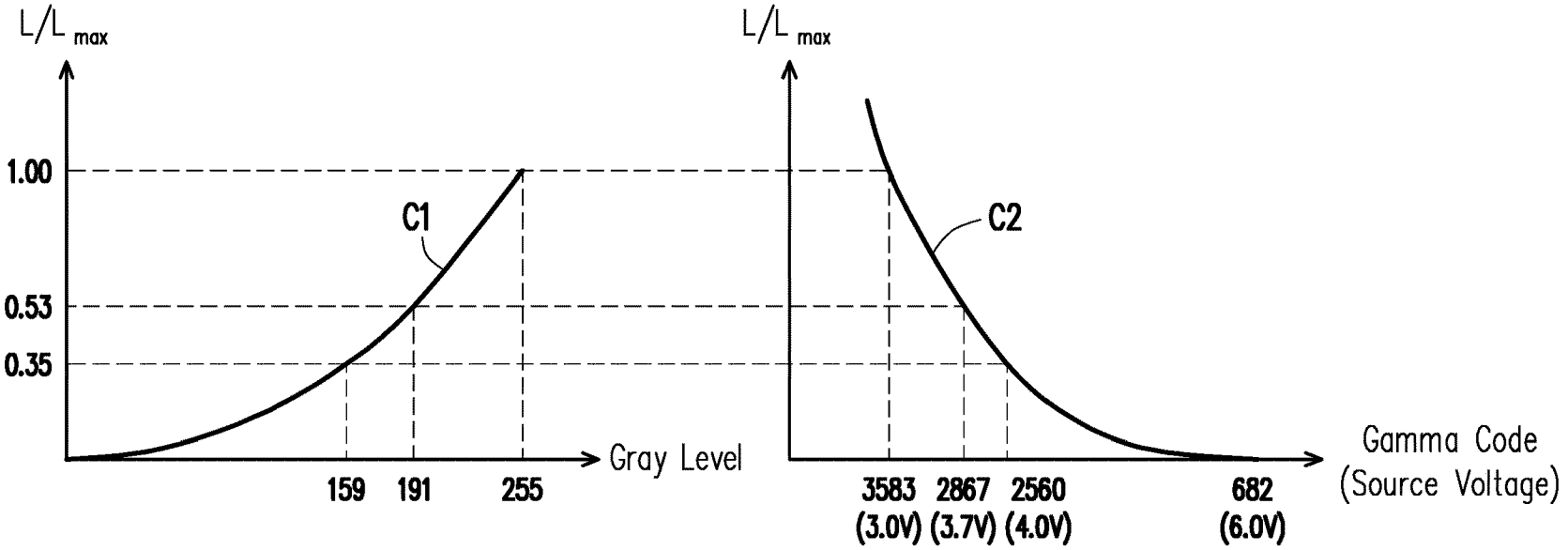
FIG. 6A and FIG. 6B illustrate a schematic diagram of a gamma mapping operation of the gamma mapping circuit depicted in FIG. 4.
Figure 6B:
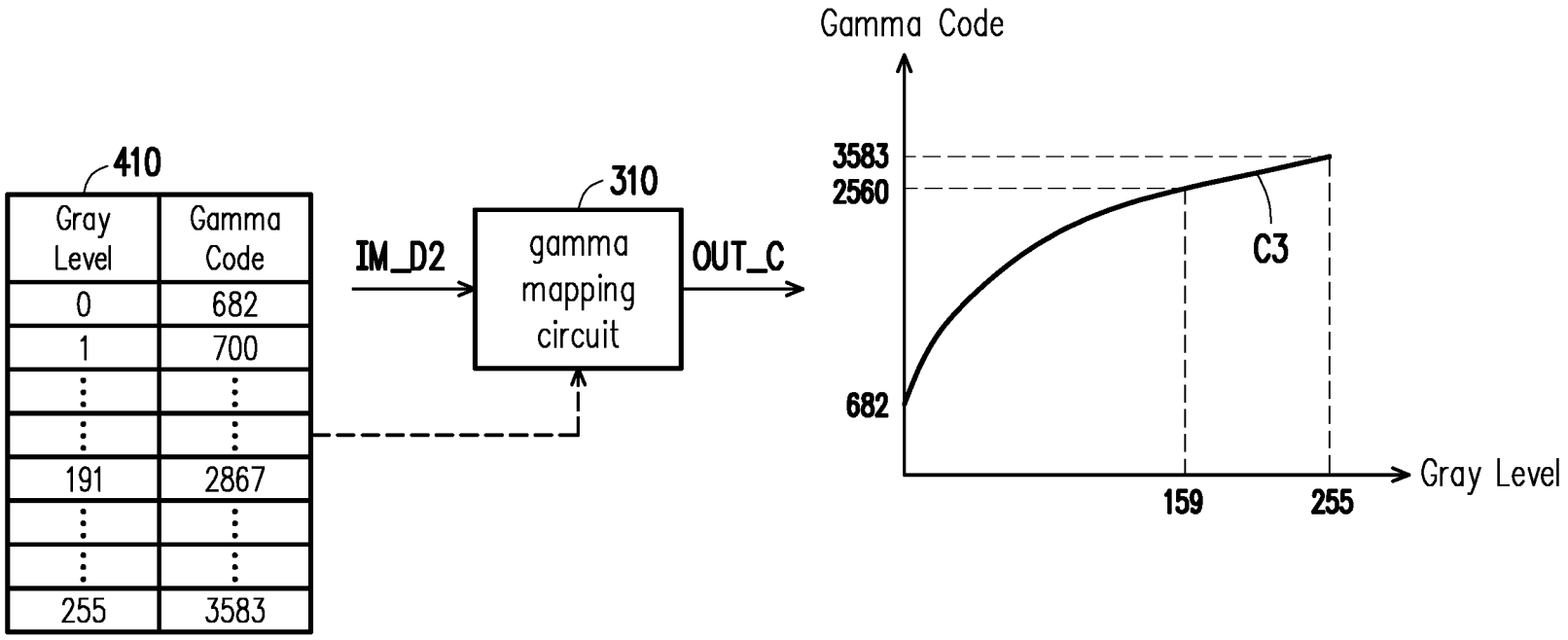

FIG. 6A and FIG. 6B illustrate a schematic diagram of a gamma mapping operation according to an embodiment. The gamma mapping operation can be applied to (but not limited to) the gamma mapping circuit depicted in FIG. 4. Referring to FIG. 6A and FIG. 6B, the gamma table 410 of the present embodiment can be stored in the driving apparatus 400 or can be realized in other forms implementing the relationship recorded in the gamma table 410. The gamma table 410 can record a plurality of values of gamma code respectively corresponding to a plurality of values of gray level. The left column of the gamma table 410 corresponds to a characteristic of luminance versus gray level, where the horizontal axis is gray level and the vertical axis is normalized brightness $L/L_{max}$ of the display panel. The curve C1 may change according to one or more characteristics of the display panel such as process, material, gamma parameter, brightness or color temperature. The right column of the gamma table 410 corresponds to a characteristic of luminance versus gamma code (source voltage), where the horizontal axis is gamma code (source voltage) and the vertical axis is normalized brightness $L/L_{max}$ of the display panel. The curve C2 can be obtained by measuring brightness of a normal area MN of the display panel 200, for example, and related to the characteristics of the display panel such as process, material, gamma parameter, brightness or color temperature. The gamma mapping circuit 310 maps the gray level of the image data IM_D2 to the gamma code OUT_C according to the gamma table 410 or based on a corresponding relationship realized in other forms, and outputs the gamma code OUT_C. The output of the gamma mapping circuit 310 corresponds to a characteristic of gamma code versus gray level, where the horizontal axis is gray level and the vertical axis is gamma code. The curve C3 may change according to the characteristics of the display panel such as process, material, gamma parameter, brightness or color temperature.

Figure 7:
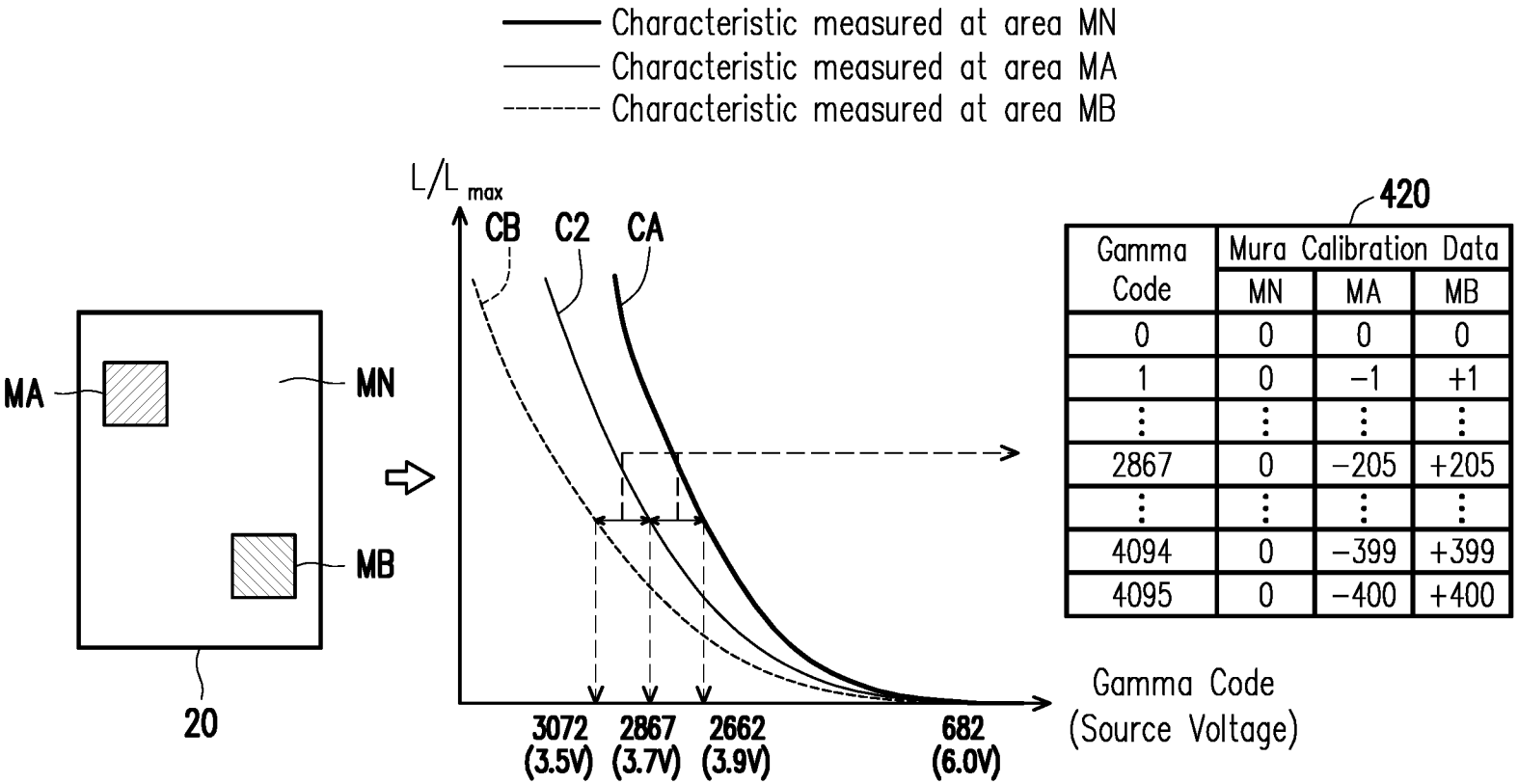
FIG. 7 illustrates a schematic diagram of a mura compensation operation of the mura compensation circuit depicted in FIG. 4 and FIG. 5.

Referring to FIG. 4 and FIG. 5, the mura compensation circuit 320 receives the gamma code OUT_C in the present embodiment. The mura compensation circuit 320 compensates the gamma code OUT_C according to the common de-mura table 420 to generate a compensation result OUT_D after the gamma mapping circuit 310 performs the step of mapping the gray level to the gamma code. FIG. 7 illustrates a schematic diagram of a mura compensation operation of the mura compensation circuit 320 depicted in FIG. 4 and FIG. 5. Referring to FIG. 7, brightness/luminance of a plurality of panel areas MN, MA and MB of the display panel 20 before mura compensation is measured, where the panel area is a normal area without mura phenomenon, and the panel areas MA and MB are mura areas with mura defects. It is noted each of the panel areas MN, MN and MB can include one or more pixels or sub-pixels. A characteristic of luminance versus gamma code (source voltage) is obtained by measuring the panel areas MN, MA and MB before mura compensation, where the horizontal axis is gamma code (source voltage) and the vertical axis is normalized brightness $L/L_{max}$ of the display panel 20. The curve C2 is obtained by measuring brightness of the normal area MN of the display panel 20. The calibration curves CA and CB can be respectively obtained by measuring brightness of the mura areas MA and MB of the display panel 20.

In the present embodiment, the common de-mura table 420 records mura calibration data for a plurality of panel areas, e.g. the panel areas MN, MA and MB. The mura calibration data is generated according to curve difference as shown in FIG. 7. The mura calibration data includes a plurality of values of mura calibration data respectively corresponding to a plurality values of gamma code for each of the panel areas. For example, the MA column includes the values of mura calibration data corresponding to the values of gamma code for the mura area MA, and other columns of the common de-mura table 420 may be deduced by analogy. The mura calibration data represents a plurality of calibration curves respectively corresponding to the plurality of panel areas. In the present embodiment, the mura calibration data of the MA column represents the calibration curve CA corresponding to the panel area MA, and the mura calibration data of the MB column represents the calibration curve CB corresponding to the panel area MB.

Referring FIG. 4 and FIG. 5, after mura compensation, the mura compensation circuit 320 outputs the compensation result OUT_D to the voltage generating circuit 340. In the present embodiment, the compensation result OUT_D includes at least one compensated gamma table 430, where the compensated gamma table 430 includes compensated values of gamma codes. The voltage generating circuit 340 receives the compensation result OUT_D, and generates a display voltage OUT_V according to the compensated gamma table 430 to drive the display panel 200.

In the present embodiment, the voltage generating circuit 340 includes a digital-to-analog (D/A) converter 342 and an operating amplifier 344. The digital-to-analog converter 342 receives the compensation result OUT_D, and converts the compensation result OUT_D of digital format to the compensation result OUT_A of analog format according to the compensated gamma table 430. The operating amplifier 344 receives the compensation result OUT_A and generates the display voltage OUT_V to drive the display panel 200.

As shown in FIG. 4 to FIG. 7, the mura compensation operation is performed on gamma codes after the gamma mapping operation. The gamma codes for different display areas are compensated according to the mura calibration data. The compensation result is outputted to the voltage generating circuit to be converted into analog voltage for driving the display panel. In FIG. 7, after the display panel is manufactured, the characteristic of luminance versus gamma code (source voltage) may be obtained by measuring sub-pixel brightness of the display panel with respect to gamma code (source voltage). While mura phenomenon occurs, different calibration curves such as the curves CA and CB depicted in FIG. 7 may be obtained. Accordingly, the mura calibration data of the common de-mura table 420 including the values of mura calibration data respectively corresponding to the values of gamma code for each of the panel areas is generated according to curve difference. The common de-mura table 420 may be stored in the driving apparatus 400 for the mura compensation. After the mura compensation is performed on the gamma code, the corresponding source voltage has been compensated for different mura areas, and thus the display panel driven by the driving apparatus according to the source voltage may provide good display quality. The mura effect of the display panel is reduced.

In addition, since the common de-mura table 420 for each of the panel areas is generated according to the curve difference, the common de-mura table 420 does not change while the gamma table changes. The common de-mura table 420 is the same when a setting of the gamma table is modified based on one or more characteristics of the display panel such as process, material, gamma parameter, brightness or color temperature. Size of memory for storing the common de-mura table 420 can be reduced in the driving apparatus.

In the present embodiment, the circuit blocks of the driving apparatus 400 may be implemented by using adaptive circuit structures in the related art, which are not particularly limited in the disclosure. In addition, the foregoing values of calibration data, gamma codes and gray levels are exemplary for description and not intended to limit the disclosure.

Figure 8:
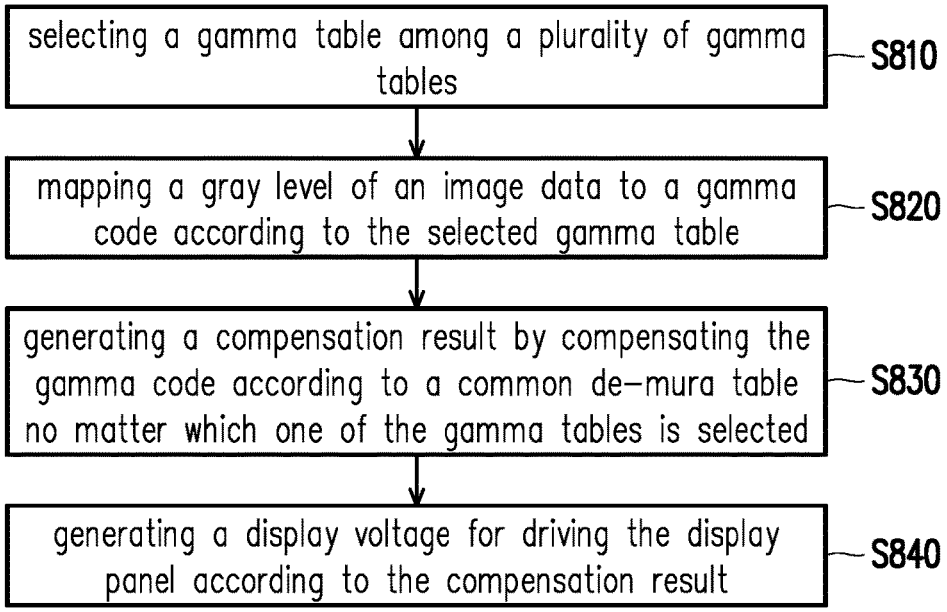
FIG. 8 is a flowchart illustrating steps in a method for driving a display panel according to another exemplary embodiment.

FIG. 8 is a flowchart illustrating steps in a method for driving a display panel according to another exemplary embodiment. The method can be applied to (but not limited to) any or a combination of the other embodiments of the disclosure. Referring to FIG. 4, FIG. 5 and FIG. 8, the method of the present embodiment is at least adapted to the driving apparatus 400 of FIG. 4 and FIG. 5, but the disclosure is not limited thereto. Taking the driving apparatus 400 for example, in step S810, the gamma mapping circuit 310 of the conversion circuit 440 selects a gamma table 410 among a plurality of gamma tables. In step S820, the gamma mapping circuit 310 of the conversion circuit 440 maps a gray level of an image data IM_D2 to a gamma code OUT_C according to the selected gamma table 410. In step S830, the mura compensation circuit 320 of the conversion circuit 440 generates a compensation result OUT_D by compensating the gamma code OUT_C according to one common de-mura table 420 no matter which one of the gamma tables is selected after the step of mapping the gray level to the gamma code OUT_C. In step S840, the voltage generating circuit 340 of the driving apparatus 400 generates a display voltage OUT_V for driving the display panel 200 according to the compensation result OUT_D. The mura effect of the display panel 200 is reduced.

Besides, the method for driving the display panel described in this embodiment of the disclosure is sufficiently taught, suggested, and embodied in the embodiments illustrated in FIG. 1 to FIG. 7, and therefore no further description is provided herein.

Figure 9:
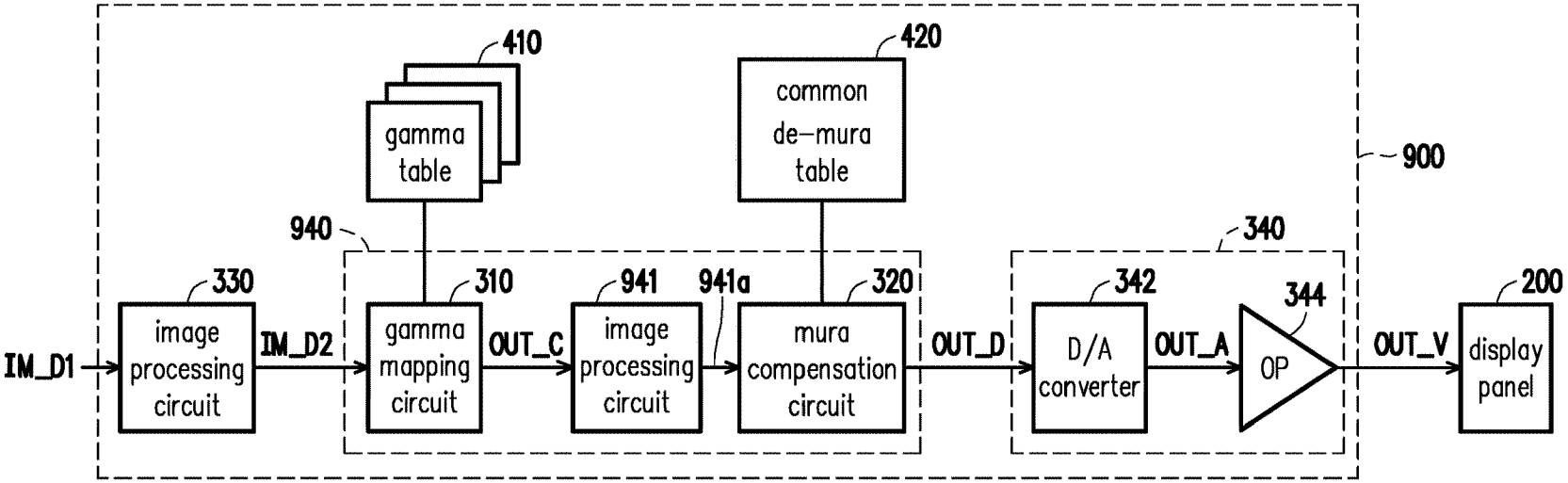
FIG. 9 illustrates a circuit block diagram of a driving apparatus for a display panel according to another exemplary embodiment.

FIG. 9 illustrates a circuit block diagram of a driving apparatus 900 for a display panel 200 according to another exemplary embodiment. The driving apparatus 900 includes an image processing circuit 330, a conversion circuit 940, and a voltage generating circuit 340. Details with respect to the driving apparatus 900, the image processing circuit 330, the conversion circuit 940, and the voltage generating circuit 340 may inferred with reference to the descriptions related to the driving apparatus 400, the image processing circuit 330, the conversion circuit 440, and the voltage generating circuit 340 illustrated in FIG. 4 to FIG. 8 and thus, will not be repeated.

In the present embodiment of FIG. 9, the conversion circuit 940 includes a gamma mapping circuit 310, an image processing circuit 941 and a mura compensation circuit 320. The gamma mapping circuit 310 receives the gray level of the image data IM_D2. The gamma mapping circuit 310 selects the selected gamma table 410 among the plurality of gamma tables. The gamma mapping circuit 310 maps the gray level to the gamma code OUT_C according to the selected gamma table 410.

The image processing circuit 941 is coupled to the gamma mapping circuit 310 for receiving the gamma code OUT_C. The image processing circuit 941 performs an image processing, such as image enhancement, sub-pixel rendering, etc., on the gamma code OUT_C to generate a processing result 941*a*. According to the design requirement, the image processing includes saturation processing, hue processing, contrast adjustment, sharpness adjustment, gamut adjustment, brightness adjustment, sub-pixel rendering, IR drop compensation and/or other image processing. The image processing circuit 941 outputs the processing result 941*a* to the mura compensation circuit 320. The mura compensation circuit 320 is coupled to the image processing circuit 941 for receiving the processing result 941*a*, and compensate the processing result 941*a* according to the common de-mura table 420 to generate the compensation result OUT_D. Details with respect to the gamma table 410, the common de-mura table 420, the gamma mapping circuit 310 and the mura compensation circuit 320 may inferred with reference to the descriptions related to the gamma table 410, the common de-mura table 420, the gamma mapping circuit 310 and the mura compensation circuit 320 illustrated in FIG. 4 to FIG. 8 and thus, will not be repeated.

Figure 10:
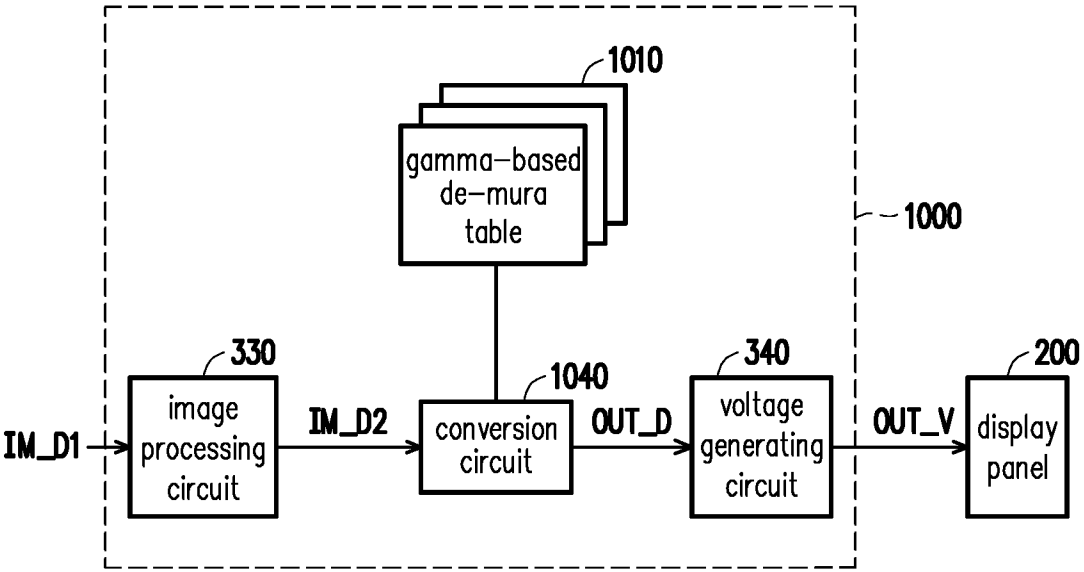
FIG. 10 illustrates a circuit block diagram of a driving apparatus for a display panel according to another exemplary embodiment.

FIG. 10 illustrates a circuit block diagram of a driving apparatus 1000 for a display panel 200 according to another exemplary embodiment. The driving apparatus 1000 includes an image processing circuit 330, a conversion circuit 1040 and a voltage generating circuit 340. Details with respect to the driving apparatus 1000, the image processing circuit 330, the conversion circuit 1040, and the voltage generating circuit 340 may inferred with reference to the descriptions related to the driving apparatus 400, the image processing circuit 330, the conversion circuit 440, and the voltage generating circuit 340 illustrated in FIG. 4 to FIG. 8 and thus, will not be repeated. The conversion circuit 1040 receives the image data IM_D2 from the image processing circuit 330.

The driving apparatus 1000 have a plurality of gamma-based de-mura tables (e.g. the gamma-based de-mura table 1010 in FIG. 10). Each of the gamma-based de-mura tables records relationship between a plurality of compensation results and a plurality of gray levels. The gamma-based de-mura tables are used in different operation situations. In general, Gamma curve can be adjusted for different scene modes (e.g., brightness, color temperature, etc.). For example, one of the gamma-based de-mura tables is used for dark scene mode, but another one of the gamma-based de-mura tables is used for bright scene mode. The example of the content of the gamma-based de-mura table 1010 in FIG. 10 may inferred with reference to the descriptions related to the compensated gamma table 430 illustrated in FIG. 5 and thus, will not be repeated.

The conversion circuit 1040 selects a table 1010 among the gamma-based de-mura tables. The conversion circuit 1040 compensates a gray level of the image data IM_D2 according to the selected table 1010 to generate a compensation result OUT_D. The conversion circuit 1040 outputs the compensation result OUT_D to the voltage generating circuit 340.

Figure 11:
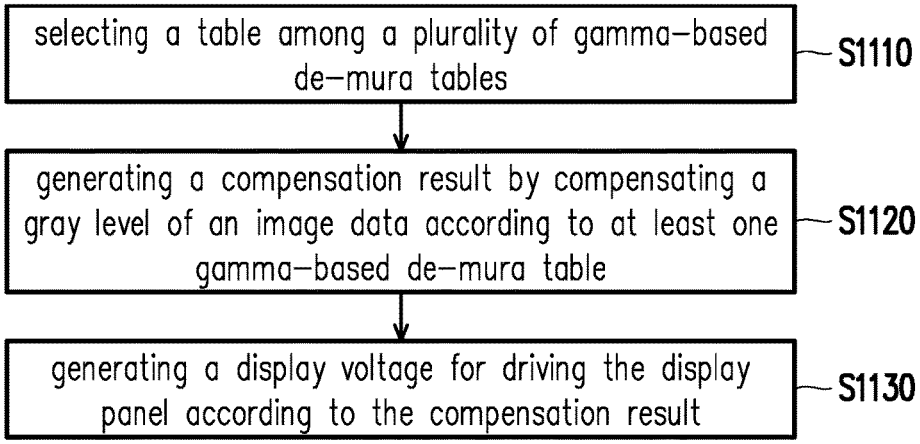
FIG. 11 is a flowchart illustrating steps in a method for driving a display panel according to another exemplary embodiment.

FIG. 11 is a flowchart illustrating steps in a method for driving a display panel according to another exemplary embodiment. The method can be applied to (but not limited to) any or a combination of the other embodiments of the disclosure. Referring to FIG. 10 and FIG. 11, the method of the present embodiment is at least adapted to the driving apparatus 1000 of FIG. 10, but the disclosure is not limited thereto. Taking the driving apparatus 1000 for example, in step S1110, the conversion circuit 1040 selects a table 1010 among a plurality of gamma-based de-mura tables. In step S1120, the conversion circuit 1040 generates a compensation result OUT_D by compensating a gray level of an image data IM_D2 according to at least one gamma-based de-mura table (the selected table 1010). In step S1130, the voltage generating circuit 340 of the driving apparatus 1000 generates a display voltage OUT_V for driving the display panel 200 according to the compensation result OUT_D. The mura effect of the display panel 200 is reduced.

The disclosure also discloses a display device, which comprises a display panel and a driving apparatus configured to have the structures or to perform the steps as illustrated by any of the above embodiments, alone or combined. The disclosure also discloses an electronic device comprising the display device.

In summary, in the exemplary embodiments of the disclosure, the setting of the gamma table can be modified based on the characteristics of the display panel. The mura compensation operation can be performed directly or indirectly after the gamma mapping operation. The mura effect of the display panel can be reduced. The de-mura table including the mura calibration data can therefore be the same even when the setting of the gamma table is modified. Moreover, the mura calibration data can be generated according to curve differences, wherein the curves can be gamma curves measured in different areas on a display panel. Accordingly, the memory size for storing the de-mura table can be reduced in the driving apparatus.

All methods described herein can be performed in any suitable order unless otherwise indicated herein or otherwise clearly contradicted by context. It will be recognized that while certain features are described in terms of a specific sequence of steps of a method, these descriptions are only illustrative of the broader methods disclosed herein, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claimed herein. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A driving apparatus for a display panel, comprising:

a conversion circuit, configured to receive an image data, select a gamma table among a plurality of gamma tables, map a gray level of the image data to a gamma code according to the selected gamma table, and generate a compensation result by compensating the gamma code according to a common de-mura table no matter which one of the gamma tables is selected after the conversion circuit maps the gray level to the gamma code; and a voltage generating circuit, coupled to the conversion circuit for receiving the compensation result, and configured to generate at least one display voltage for driving the display panel according to the compensation result, wherein the conversion circuit comprises:

a gamma mapping circuit configured to receive the gray level of the image data, select the selected gamma table among the plurality of gamma tables, map the gray level to the gamma code according to the selected gamma table, and output the gamma code, wherein the gamma code indicates the gamma-compensated gray level of the image data; and a mura compensation circuit configured to receive the gamma code, and compensate the gamma code according to the common de-mura table to generate the compensation result after the gamma mapping circuit maps the gray level to the gamma code, wherein the compensation result indicates the mura-compensated gamma code, wherein the common de-mura table records mura calibration data for a plurality of panel areas on the display panel, wherein the mura calibration data comprises a plurality of values of mura calibration data respectively corresponding to a plurality values of gamma code for each of the panel areas, and wherein the mura calibration data represents a plurality of calibration curves respectively corresponding to the plurality of panel areas, and includes a plurality of values of mura calibration data respectively corresponding to a plurality of gamma codes for each of the panel areas.

2. The driving apparatus according to claim 1, wherein the gamma tables respectively record relationship between a plurality of gamma codes and a plurality of gray levels.

3. The driving apparatus according to claim 1, wherein the common de-mura table is the same when the selected gamma table is changed.

4. A driving apparatus for a display panel, comprising:

a conversion circuit, configured to receive an image data, select a gamma table among a plurality of gamma tables, map a gray level of the image data to a gamma code according to the selected gamma table, and generate a compensation result by compensating the gamma code according to a common de-mura table no matter which one of the gamma tables is selected after the conversion circuit maps the gray level to the gamma code; and a voltage generating circuit, coupled to the conversion circuit for receiving the compensation result, and configured to generate at least one display voltage for driving the display panel according to the compensation result, wherein the conversion circuit comprises:

a gamma mapping circuit configured to receive the gray level of the image data, select the selected gamma table among the plurality of gamma tables, and map the gray level to the gamma code according to the selected gamma table;

an image processing circuit, coupled to the gamma mapping circuit and configured to receive the gamma code and perform an image processing on the gamma code to generate a processing result; and a mura compensation circuit, coupled to the image processing circuit and configured to receive the processing result and compensate the processing result according to the common de-mura table to generate the compensation result, wherein the common de-mura table records mura calibration data for a plurality of panel areas on the display panel, wherein the mura calibration data comprises a plurality of values of mura calibration data respectively corresponding to a plurality values of gamma code for each of the panel areas, and wherein the mura calibration data represents a plurality of calibration curves respectively corresponding to the plurality of panel areas, and includes a plurality of values of mura calibration data respectively corresponding to a plurality of gamma codes for each of the panel areas.

5. A method for driving a display panel comprising:

selecting a gamma table among a plurality of gamma tables by a conversion circuit;

mapping a gray level of an image data to a gamma code according to the selected gamma table by the conversion circuit;

generating a compensation result by compensating the gamma code according to a common de-mura table no matter which one of the gamma tables is selected after the step of mapping the gray level to the gamma code by the conversion circuit; and generating a display voltage for driving the display panel according to the compensation result by a voltage generating circuit, wherein the gamma code indicates the gamma-compensated gray level of the image data, wherein the compensation result indicates the mura-compensated gamma code, wherein the common de-mura table records mura calibration data for a plurality of panel areas on the display panel, wherein the mura calibration data comprises a plurality of values of mura calibration data respectively corresponding to a plurality values of gamma code for each of the panel areas, and wherein the mura calibration data represents a plurality of calibration curves respectively corresponding to the plurality of panel areas, and includes a plurality of values of mura calibration data respectively corresponding to a plurality of gamma codes for each of the panel areas.

6. The method according to claim 5, wherein the gamma tables respectively record relationship between a plurality of gamma codes and a plurality of gray levels.

7. The method according to claim 5, wherein the common de-mura table is the same when the selected gamma table is changed.

* * * * *